US005078104A

United States Patent [19]

Peterson, Jr.

[11] Patent Number: 5,078,104

[45] Date of Patent: Jan. 7, 1992

[54] INTERLOCK CIRCUIT FOR BOTH ELECTRIC AND MANUAL STARTING

[75] Inventor: Rudolph A. Peterson, Jr., Horicon, Wis.

[73] Assignee: Deere & Company, Moline, Ill.

[21] Appl. No.: 648,090

[22] Filed: Jan. 31, 1991

[51] Int. Cl.[5] ..... F02N 3/02; F02N 11/08

[52] U.S. Cl. ..... 123/179.24; 192/84 R; 123/179.4; 123/179.5; 123/179.23

[58] Field of Search ..... 123/179 P, 179 K, 179 B, 123/179 BG; 192/84 R; 74/850

[56] References Cited

U.S. PATENT DOCUMENTS 3,521,612 7/1970 Santi et al. ..... 123/179 K
3,613,482 10/1971 Benson, Jr. et al. ..... 123/179 K
3,718,128 2/1973 Botker ..... 123/179 K
4,223,657 9/1980 Sato et al. ..... 123/179 K
4,651,018 3/1987 Peterson, Jr. ..... 307/10
4,974,711 12/1990 Peterson, Jr. et al. ..... 192/12 D

*Primary Examiner*—Andrew M. Dolinar

[57] ABSTRACT

An interlock circuit is provided wherein a foot switch connected through a diode to the alternator is depressed during rope-pull starting and provides power from the alternator to energize a relay and disable a magneto kill circuit to facilitate manual start. As the engine turns over and current flows from the alternator, the relay is bootstrapped to the energized position so that the engine remains running even after the foot switch is released. Normal interlock features, such as those which rely on operator presence or the transmission being in neutral, remain operational without additional switches and without need for a battery being present in the circuit.

12 Claims, 1 Drawing Sheet

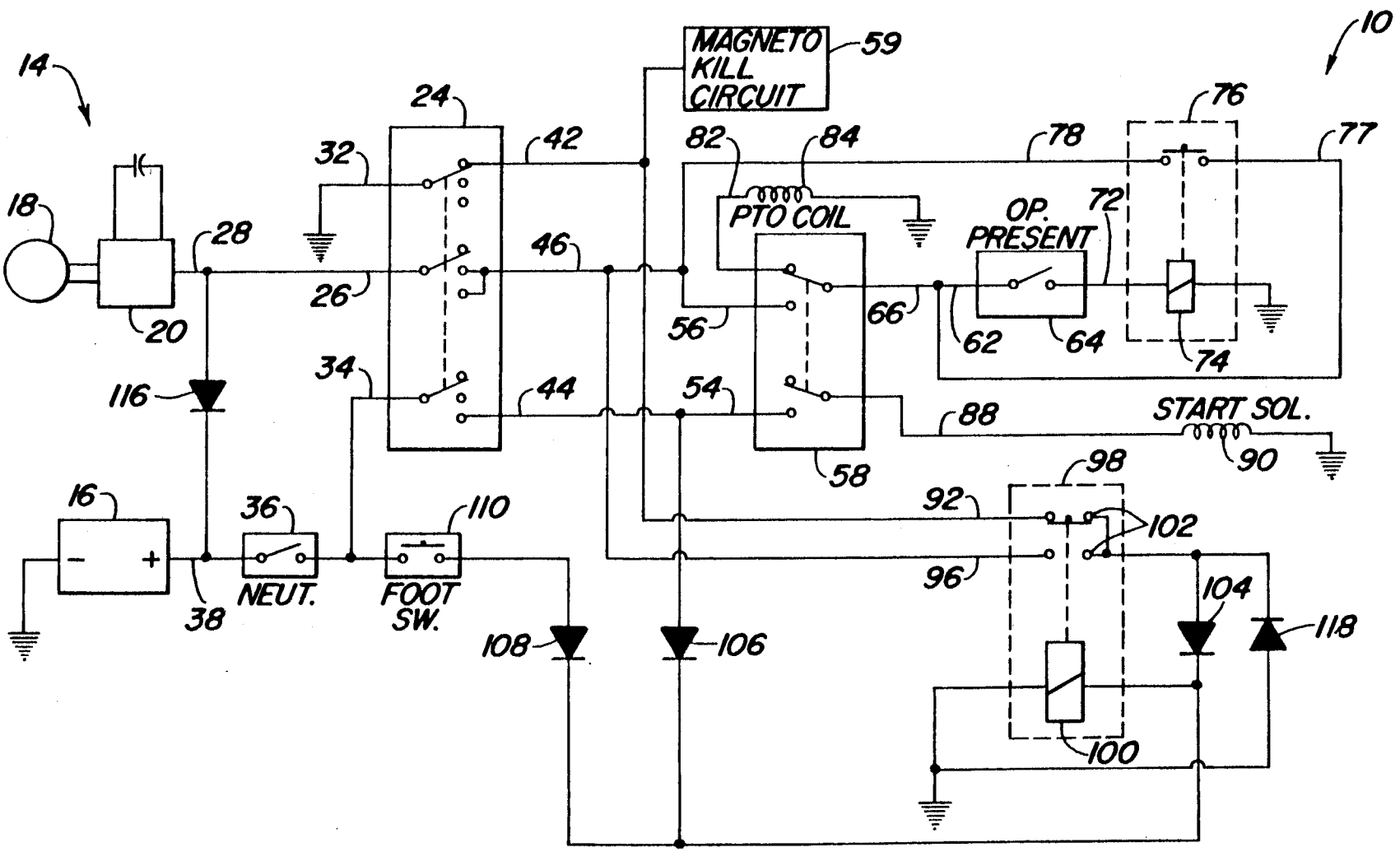
MAGNETO KILL CIRCUIT
OP. PRESENT
PTO COIL
START SOL.
FOOT SW.
NEUT.

INTERLOCK CIRCUIT FOR BOTH ELECTRIC AND MANUAL STARTING

BACKGROUND OF THE INVENTION

1. Field of the Invention

The present invention relates generally to interlock circuits for vehicles such as lawn mowers and the like, and more specifically to such circuits which permit the vehicle engine to be started in the absence of battery power.

2. Related Art

For sensing and control, interlock circuits for magneto ignition engines have usually required use of one or more of the following: the magneto pulse; the alternator output; or the battery power. Some vehicle systems cannot operate at all without a battery. Available circuits which allow either battery start or manual pull start require either a special transmission switch or rope pull switch, or such circuits sacrifice one or more of the features of the interlock circuit to facilitate starting and running without battery power.

BRIEF SUMMARY OF THE INVENTION

It is therefore an object of the present invention to provide an improved interlock circuit for a vehicle which facilitates both manual and electric starting. It is yet another object to provide such a circuit which does not sacrifice interlock operation when the engine is started manually or run without a battery. It is another object of the invention to provide such a circuit which allows the engine to be started and run without any battery at all.

It is still another object of the invention to provide an improved interlock circuit for a vehicle which allows both battery-powered starting or pull starting without changing any of the standard operating features of the interlock circuit. It is a further object to provide such a circuit which does not require a special transmission or rope-pull switch, and which does not require part of the magneto power to be diverted from the engine.

An interlock circuit is provided wherein alternator power is isolated from the battery with a diode. A foot switch connected t the diode and depressed during rope-pull starting directs power from the alternator to energize a relay and disable a magneto kill circuit to facilitate manual start. As the engine turns over and current flows from the alternator, the relay is bootstrapped to the energized position so that the engine remains running even after the foot switch is released. Normal interlock operation is provided, even when the battery is removed or discharged, without additional switches and without added drain on the magneto.

These and other objects, features and advantages of the present invention will become apparent to one skilled in the art upon reading the following detailed description in view of the drawings.

BRIEF DESCRIPTION OF THE DRAWING

The single drawing figure is a schematic representation of the ignition and interlock circuitry of the present invention.

DETAILED DESCRIPTION OF THE DRAWING

Referring now to the drawing, therein is shown an interlock circuit 10 for such as a front mounted mower or similar vehicle. The vehicle includes a conventional engine with a magneto (not shown) and electrical charging and storage system 14. The electrical system !4 includes a storage battery 16, an alternator 18 and a voltage regulator 20.

A three-position ignition switch 24 includes a first input terminal 26 connected to an output terminal 28 of the regulator 20, a second input terminal 32 connected to ground, and a third input 34 connected through a transmission switch 36 to positive terminal 38 of the battery 16. The switch 24 includes output terminals 42, 44 and 46 corresponding to the input terminals 32, 34 and 36, respectively. The output terminals 44 and 46 of the ignition switch 24 are connected to terminals 54 and 56, respectively, of a power take off (PTO) switch 58. The terminal 42 is connected to a magneto kill circuit 59 which assures the engine will not run when the terminal 42 is grounded, such as when the ignition switch 24 is in the uppermost or off position as shown.

An input terminal 62 on an operator presence switch 64 located at the operator's station on the vehicle is connected to a terminal 66 on the PTO switch 58. Output terminal 72 of the switch 64 is connected to relay coil 74 of a relay 76. The relay 76 is open in the unenergized state (shown); a closed path from the terminal 66 of the PTO switch to the terminal 46 of the ignition switch 24 is established through the relay 76 via lines 77, 78 when the coil 74 is energized.

The PTO switch 58 includes a terminal 82 connected to the PTO clutch coil 84 for engaging the PTO to drive an implement (not shown) such as the mower unit which is supported on the vehicle. A terminal 88 of the PTO switch 58 is connected to a starter solenoid 90 and provides a closed path between the output terminal 44 on the ignition switch 24 and the starter solenoid 90 only when the PTO switch is in the off (down) position.

The ignition switch output terminals 42 and 46 are connected to terminals 92 and 96 of a relay 98 having a coil 100, one side of which is connected to ground and the opposite side of which is coupled to the remaining terminal 102 of the relay 98 through a diode 104. A second diode 106 is connected between the output terminal 44 of the ignition switch 24 and the coil 100. A third diode 108 is connected to the coil 100 and to an output terminal of a normally open foot switch 110 located adjacent the pull-start for the engine. The input terminal of the foot switch 110 is connected to the input terminal 34 of the ignition switch 24 and to the transmission switch 36. A diode 116 is connected from the regulator 20 to the positive terminal of the battery 16 and the input of the transmission switch 36 so that when the foot switch 110 is depressed and the transmission is in neutral (i.e., the switch 36 is closed), a current path will be established between the alternator-regulator and the coil 100 of the relay 98. When the coil 100 is not energized, the relay will be in the position shown so that the terminal 42 and thus the input to the kill circuit 59 will be grounded through the diode 104 and the coil 100, as well as through a diode 118, to prevent the engine from starting and running.

In operation, with the ignition switch 24 in the off position as shown, the terminal 42 will be grounded through the terminal 32 to assure that the kill circuit 59 is enabled and the engine will not run. To start the engine normally when the battery 16 is present and functioning properly, the switch 24 is moved to the lowermost position so that the terminal 42 is no longer connected through the terminal 32 to ground, and the terminals 44 and 46 are connected to the terminals 34 and 26, respectively. If the transmission is in neutral so the switch 36 is closed, the coil 100 will be energized by current flowing from the terminal 44 through the diode 106 to activate the relay 98 and disable the magneto kill circuit 59. If the PTO switch is off to close the circuit between the terminals 54 and 88, the starter solenoid will be activated to start the engine. After the engine is running, the switch 24 is released from the start position to the central run position.

In the event battery power is not available and the operator wishes to start the engine, he turns the ignition switch 24 to the central run position, depresses the foot switch 110 and places the transmission in neutral so the switch 36 is closed. Current from the alternator 18 can then flow through the diode 116, switches 36 and 110, and the diode 108 to the coil 100 to disable the magneto kill circuit 59 as soon as the operator manually turns the engine over and there is sufficient alternator output. Once the engine is running, the relay 98 is bootstrapped to the on position (down) as current from the alternator flows from the terminal 46 through the diode 104 and the coil 100. The coil 100 remains energized by current from the alternator 18 provided via switch 24 and closed terminals 96, 102 of the relay 98. The engine may be started and normal interlock operation is maintained regardless of whether or not the battery 16 is connected and/or usable. The diode 104 blocks feedback from the battery 16 to the alternator-powered interlock system.

For PTO operation, assuming that the PTO switch 58 is off (down) and operator is properly positioned on the vehicle so that the switch 64 is closed, the coil 74 will be energized to activate the relay 76 and connect lines 77 and 78 when the ignition switch 24 is on and the engine is running to produce alternator output. The switch 58 is then turned to the on position (up position) to energize the PTO coil 84 and engage the clutch. The coil 74 remains energized only so long as there power provided through the ignition switch 24 from the alternator and the operator remains at the station so the switch 64 is closed. Once the switch 64 opens or current to the coil 74 is interrupted in some other way, the switch 58 must be first turned off (down) while the switch 64 closed before PTO operation can be resumed. The PTO and operator presence interlock functions remain unaffected whether or not an operational battery 16 is present.

The transmission switch 36 must be closed (transmission in neutral) before the kill circuit 59 can be disabled to allow engine starting, whether the engine is started manually without aid of a battery or electrically using the starter solenoid 90. When using electric start, the PTO switch 58 must first be turned off (down position) for the starter solenoid 90 to be energized.

Having described the preferred embodiment, it will become apparent that various modifications can be made without departing from the scope of the invention as defined in the accompanying claims.

I claim:

1. In a vehicle having an engine, a battery, an alternator having an output terminal, an electric starter and manual start mechanism for selectively starting the engine either electrically with a battery-operated starter or manually, ignition and control circuitry comprising:

a selectively engageable engine kill circuit;

first circuit means connected to the engine kill circuit for engaging and disengaging the kill circuit, said first circuit means including a control input responsive to at least one operating condition on the vehicle for selectively preventing operation of the engine upon occurrence of the operating condition; and second circuit means selectively connecting the alternator output to the control input during manual starting to disengage the engine kill circuit utilizing alternator output and permit engine starting without battery power while retaining control input responsiveness to said operating condition.

2. The invention as set forth in claim 1 wherein the second circuit means includes:

selectively engageable and disengageable first switch means connected between the alternator and the control input for, upon engagement, temporarily connecting the output of the alternator to the control input during manual starting.

3. The invention as set forth in claim 2 wherein the first circuit means includes means for bootstrapping the control input to the alternator output once the engine has been started manually so that the engine kill circuit remains disengaged after the first switch means is disengaged.

4. The invention as set forth in claim 2 including a condition responsive switch means connected &:o the first switch means for preventing starting of the engine manually or electrically upon occurrence of said at least one operating condition.

5. The invention as set forth in claim 4 wherein the condition responsive switch means is connected in series with the first switch means.

6. The invention as set forth in claim 1 wherein the second circuit means includes a diode connected between the alternator output and a terminal on the battery, and an operator-activated switch connected between the diode and the control input.

7. The invention as set forth in claim 6 further including a condition responsive switch connected between the diode and the operator-activated switch, the state of the condition responsive switch being dependant upon the occurrence of said one operating condition.

8. The invention as set forth in claim I further including clutch-engaging circuit having a condition-responsive switch for providing an interlock function which prevents clutch operation under preselected conditions, and means for connecting the clutch-engaging circuit to the alternator output for facilitating clutch operation without battery power and providing said interlock function with and without battery power.

9. In a vehicle having an engine, a battery, an alternator having an output terminal, an electric starter and manual start mechanism for selectively starting the engine either electrically with a battery-operated starter or manually, a transmission and an engine-driven implement, ignition and control circuitry comprising:

an interlock circuit having an electrically engageable drive for selectively supplying power from the engine to the implement and including a vehicle condition-responsive switch for selectively preventing drive engagement;

an engine killing circuit having a control input responsive to a preselected condition for preventing engine operation upon occurrence of the preselected condition;

means isolating the interlock circuit from the battery for supplying power to the interlock circuit substantially entirely from the alternator for enabling interlock circuit operation regardless of battery presence or condition; and means connected to the control input for facilitating manual starting of the engine regardless of battery presence or condition.

10. The invention as set forth in claim 9 wherein the means connected to the control input includes a manual start switch connected between the output terminal and the control input and having an on state for supplying current from the alternator to the control input during starting, and an off state.

11. The invention as set forth in claim 10 further including a transmission sensing switch connected in series with the manual start switch for preventing both manual and electric starting when the vehicle transmission is not in neutral regardless of the state of the manual start switch.

12. The invention as set forth in claim 10 including means for bootstrapping the control input to the output terminal during manual starting to permit the manual switch to be in the off state after the engine is running, without stopping engine operation, so long as the alternator is supplying current.

* * * * *